US007422548B1

(12) United States Patent
Teng

(10) Patent No.: US 7,422,548 B1
(45) Date of Patent: Sep. 9, 2008

(54) EXERCISE CYCLE WITH STRETCHING HANDLE

(76) Inventor: Ju-Chuan Teng, P.O. Box 215, Taichung (TW) 40099

( * ) Notice: Subject to any disclaimer, the term of this patent is extended or adjusted under 35 U.S.C. 154(b) by 0 days.

(21) Appl. No.: 11/889,751

(22) Filed: Aug. 16, 2007

(30) Foreign Application Priority Data

May 25, 2007 (TW) ..... 96208614 U
Jul. 13, 2007 (TW) ..... 96211482 U

(51) Int. Cl.
*A63B 22/00* (2006.01)

(52) U.S. Cl. ..... 482/51; 482/57; 482/62

(58) Field of Classification Search ..... 482/1–9, 482/51, 57–65, 900–902; 434/247
See application file for complete search history.

(56) References Cited

U.S. PATENT DOCUMENTS 7,097,596 B2 * 8/2006 Yang ..... 482/57
7,097,598 B2 * 8/2006 Lee ..... 482/57
7,393,308 B1 * 7/2008 Huang ..... 482/51

* cited by examiner

*Primary Examiner*—Glenn Richman

(57) ABSTRACT

An exercise cycle with an extended handle comprises a pair of stands, a seat stand with a seat and a handle stand with a handle bar, which are crisscross pivotally engaged on the middle segment of the both stands, a set of gears pivotally engaged on the lower segment of the seat stand, a pair of pedals with cranks sets on the center of a wheel of the gears, a damper for varying the resistance of the pedal, a shock absorber to smooth the resistance of the pedal, a shaft that one end pivotally connects on a crank of the gears and the other end pivotally engaged on the handle stand, a base pivotally engaged with lower end of the handle stand, and a slide device set on the lower end of the seat stand. The seat stand and the handle stand can relatively move in a kind of scissoring movement when a user tramps on the pedal. By this way, people can exercise both upper and lower portion of the body.

4 Claims, 5 Drawing Sheets

EXERCISE CYCLE WITH STRETCHING HANDLE

BACKGROUND OF THE INVENTION

1. Field of the Invention

The present invention is related to fitness equipment; and more particularly, to an exercise cycle that provides hands and legs exercise.

2. Discussion of the Background Art

The conventional exercise cycles usually were designed with a fixed frame with a pair of pedals for a tramping exercise, which mainly exercise the lower portion of the body. The prior art was showed in U.S. patents No. 2003/0092532. There are also many weaknesses of the art on occupying the space, difficult to store, only lower body being exercised.

SUMMARY OF THE INVENTION

The present invention provides an exercise device that includes two crossing stands with a pivot axis in the middle section, a pair of pedals, a set of gears, a pulley, a damper, a seat and a handle bar for exercising the user's lower and upper body in the same time. Therefore, to achieve above functions an exercise cycle includes a seat stand with a seat on top, a handle stand that pivotally engaged with the seat stand on middle segment, a set of decelerating gears on the seat stand for driving a stick to move the handle stand forward and backward, like a scissoring movement, a pair of pedals for driving the gears and the pulley, a set of damper for regulating the tramping resistance, a pulley to accelerate the spinning speed of a resisting wheel of the damper and a shock absorber pivotally engaged both end on the handle stand and the seat stand for a smoother tramping speed. The exercise cycle provide a tramping exercise of legs when a user tramps on the pedals a resistance reacts by user's weight and the damper, and a forward and backward stretching handle drove by the gears for exercising the user's upper portion. The damper can be regulated for varying tramping resistance.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
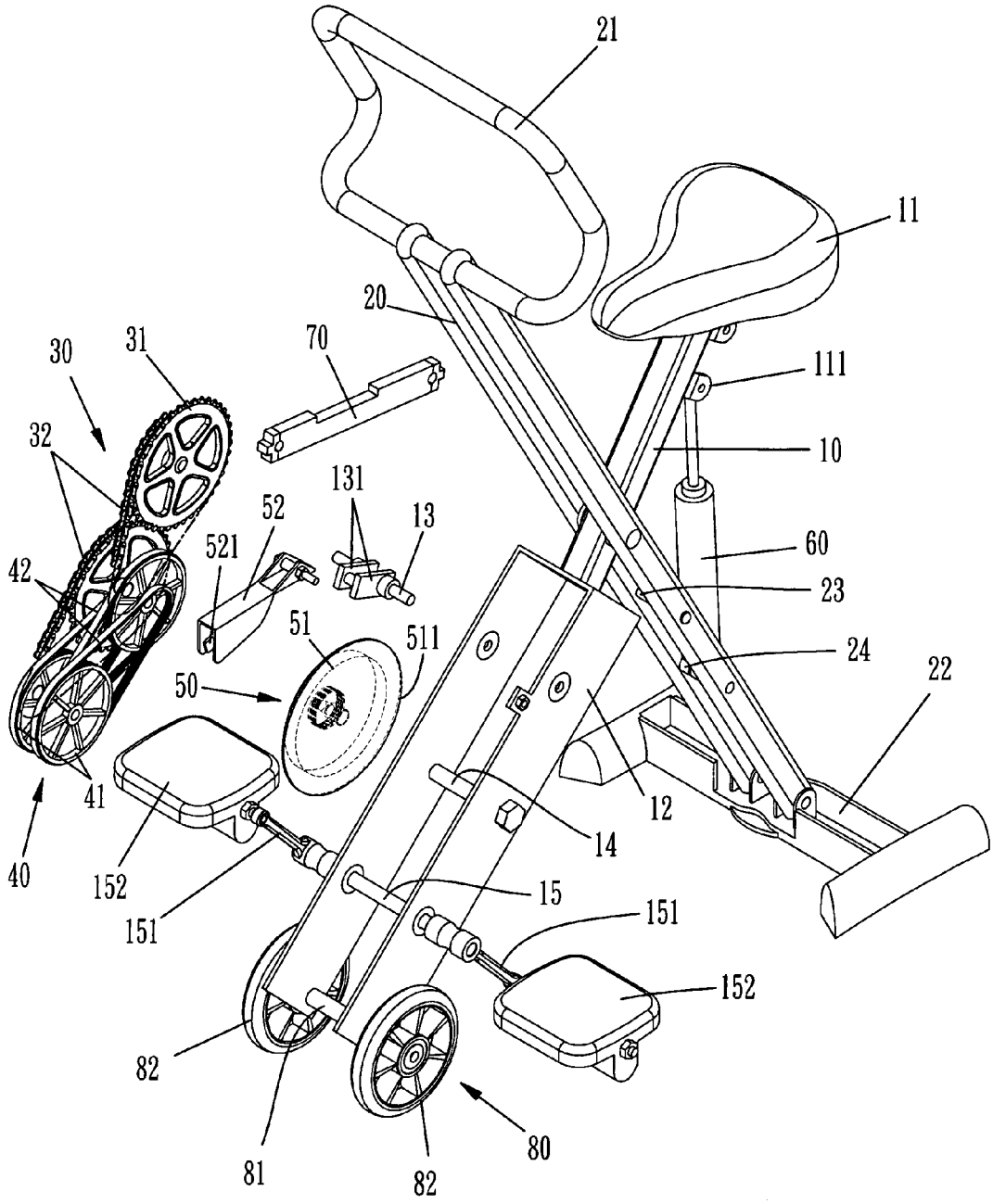
FIG. 1 is a partial explosion view of a prefer embodiment.
Figure 2:
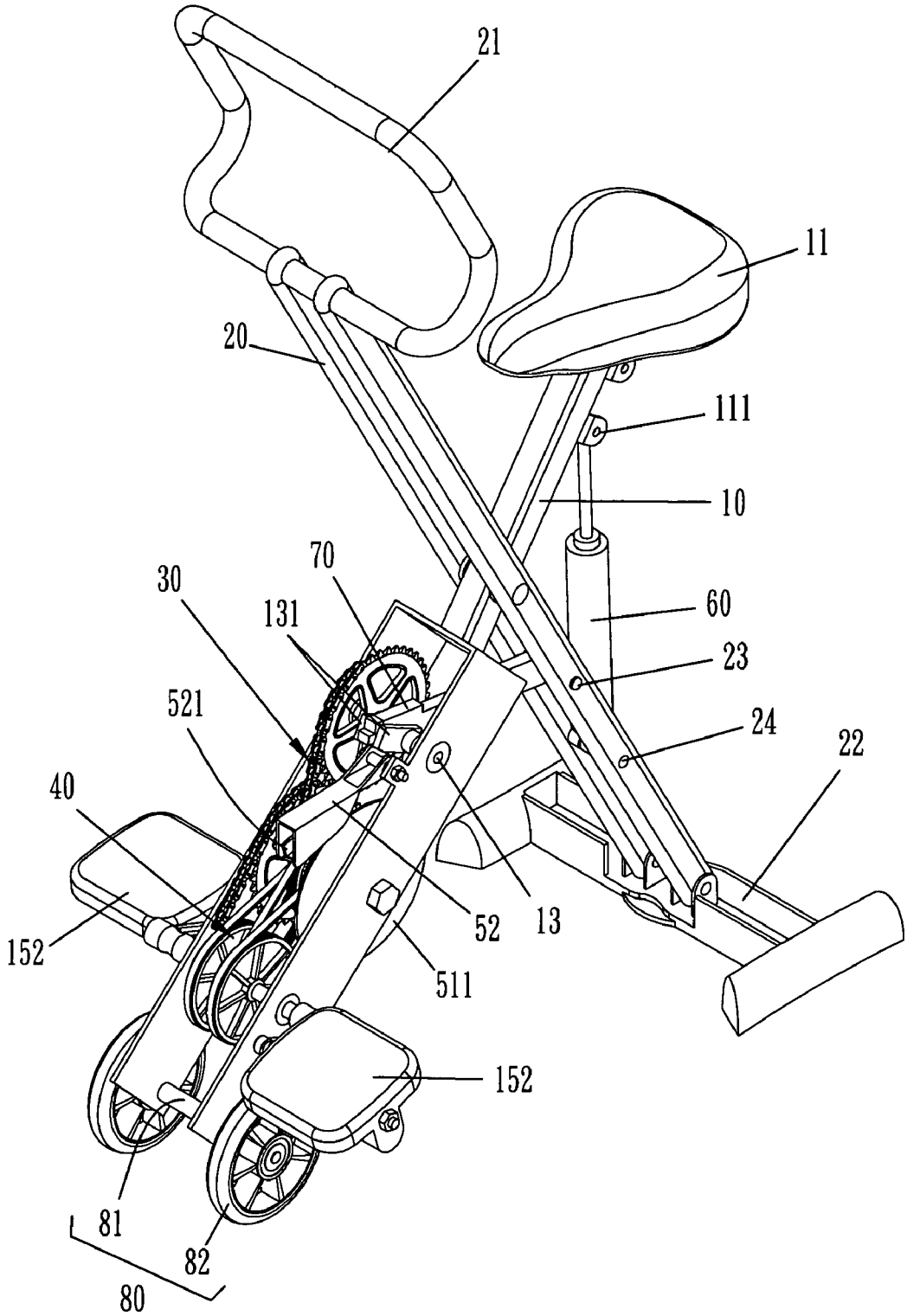
FIG. 2 is a perspective view of the device of FIG. 1.
Figure 3:
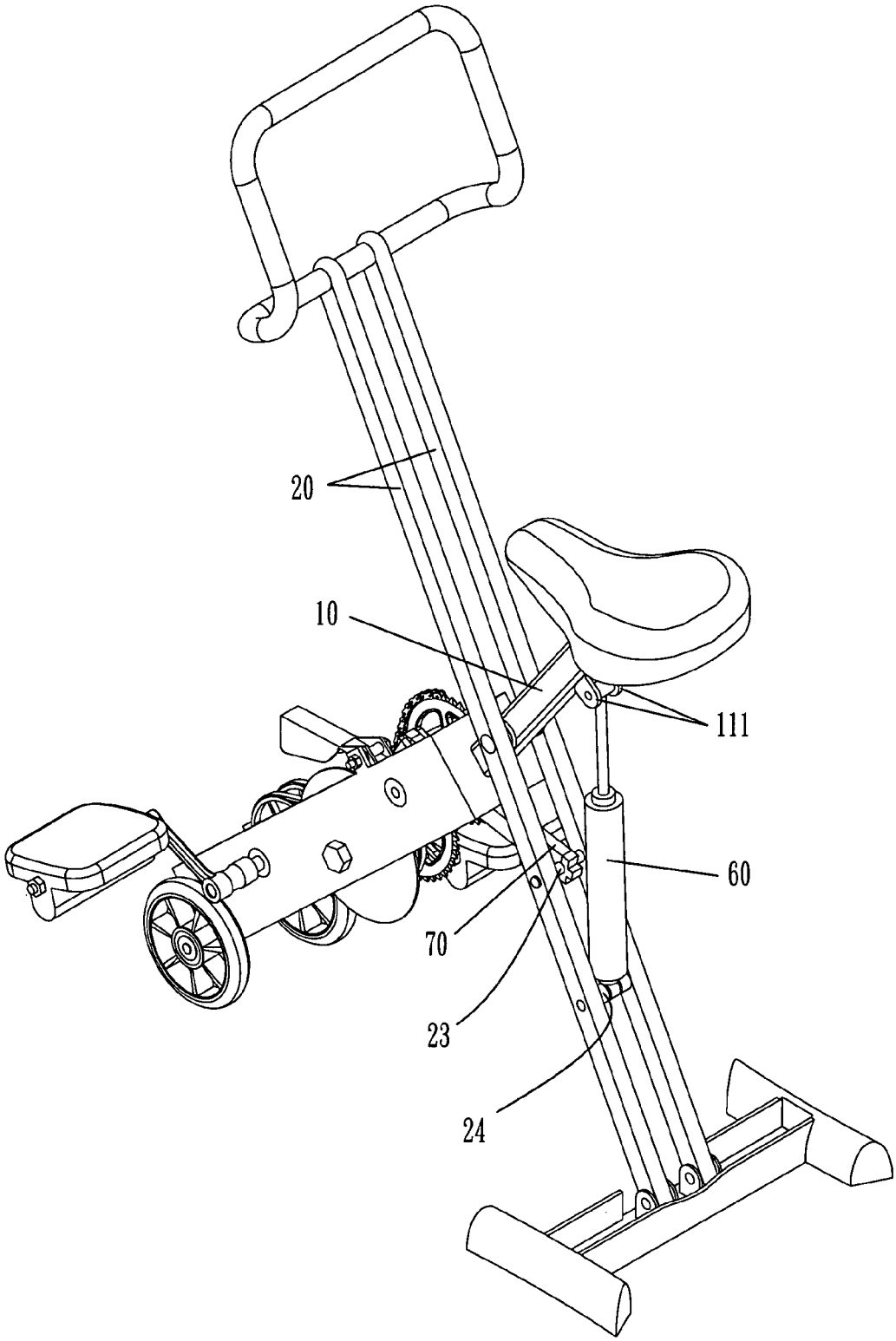
FIG. 3 is another perspective view of the device of FIG. 1 from a different view point.
Figure 4:
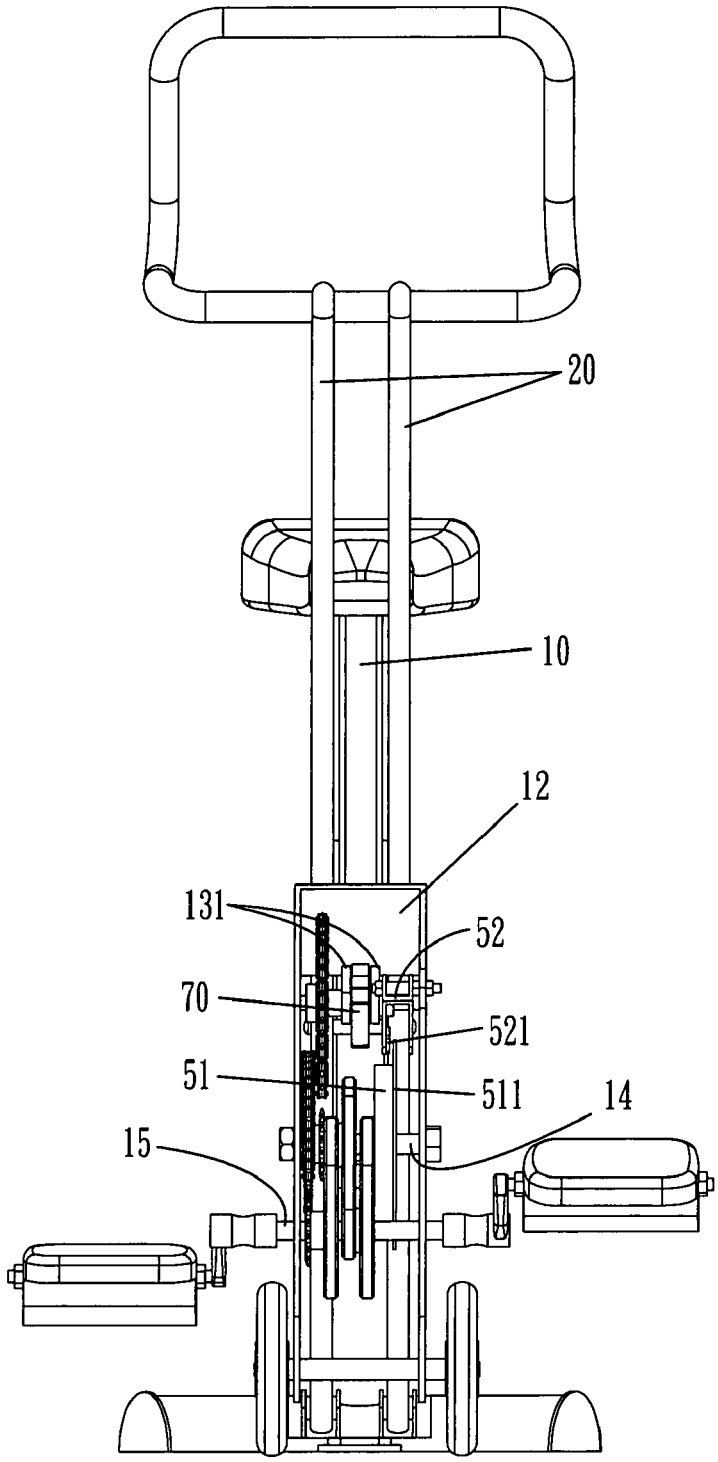
FIG. 4 is a front view of the device of FIG. 2.

A prefer embodiment of the present invention is described with the drawings as following. As showed in FIGS. 1 to 5, an exercise cycle includes a seat stand 10 and a handle stand 20 that are crisscross pivotally engaged on the middle segment of the both stands, a pair of pedal 152, a set of gears 30, a pulley 40, a damper 50, a shock absorber 60, a shaft 70, a base 22 and a slide device 80. The seat stand 10 includes a seat 11 on top, a joint 111 below the seat 11 for pivotally joining the top end of the shock absorber 60, a pair of branch stand 12 on lower portion with an upper pivot 13, a middle pivot 14 and a lower pivot 15 for supporting the gears 30 and the pulley 40, and the slide device 80 on the ground end. A crank 131 sets on the upper pivot 13 to drive the shaft 70. A resisting wheel 51 of the damper 50 sets on the middle pivot 14. A pair of pedal cranks 151 sets outside of the branch stands 12 on the lower pivot 15 with the pedals 152.

The handle stand 20 includes a pair of parallel stands that crisscross pivotally engaged on the middle segment of the seat stand 10, a foot base 22 pivotally engaged on the ground end, a shaft pivot 23 joined with the shaft 40, a bumper pivot 24 engaged with the shock absorber 60 and a handle bar 21 on the top end.

The gears 30 comprise several gear wheels 31 and two chains 32, which are pivotally engaged on the upper, middle and lower pivot 13,14,15 of the branch stands 12. The pulley 40 comprise several wheels 41 and at least two belts 42 pivotally set on the middle pivot 14 and the lower pivot 15 for driving the damper 50.

The damper 50 includes a resisting wheel 51 and a magnetic device 52. The resisting wheel 51 pivotally sets on the middle pivot 14 with a coil 511. The magnetic device 52 pivotally sets on the branch stand 12, which includes at least a magnet 521. By adjusting the distance to the coil 511 of the resisting wheel 51 can vary the resistance of the resisting wheel 51 when the coil 511 is driven to pass the magnetic field of the magnet 521. The damper 50 also can be replaced with a mechanical friction system.

The shock absorber 60, which can be a fluid or an air base bumper or a spring bumper, pivotally engages both ends on the bumper pivot 24 of the handle stand 20 and the joint 111 of the seat stand 10. The shaft 70 is pivotally engaged one end on the shaft pivot 23 and the other end on the crank 131.

The slide device 80 comprises a slide pivot 81 on the ground end of the seat stand 10 and a pair of wheels 82 on both end of the slide pivot 81.

The cranks 151 and pedals 152, when they are tramped, can drive the gears 30, the pulley 40 and the dumper 50 in the same time. The crank 131 is drive by the gear 30 to push and to pull the shaft 70 in turn. Therefore, the seat stand 10 and the handle stand 20 can move like a scissors, which movement is similar to the horse ridding for the user. When the slide device is forced forward, the seat stand 10 is correspondently push down the shock absorber 60 that restores the reacting energy for later to push back the seat stand 10. The shock absorber 60 can smoothly regulate the resistance of pedals when the user tramps on the pedal.

Figure 5:
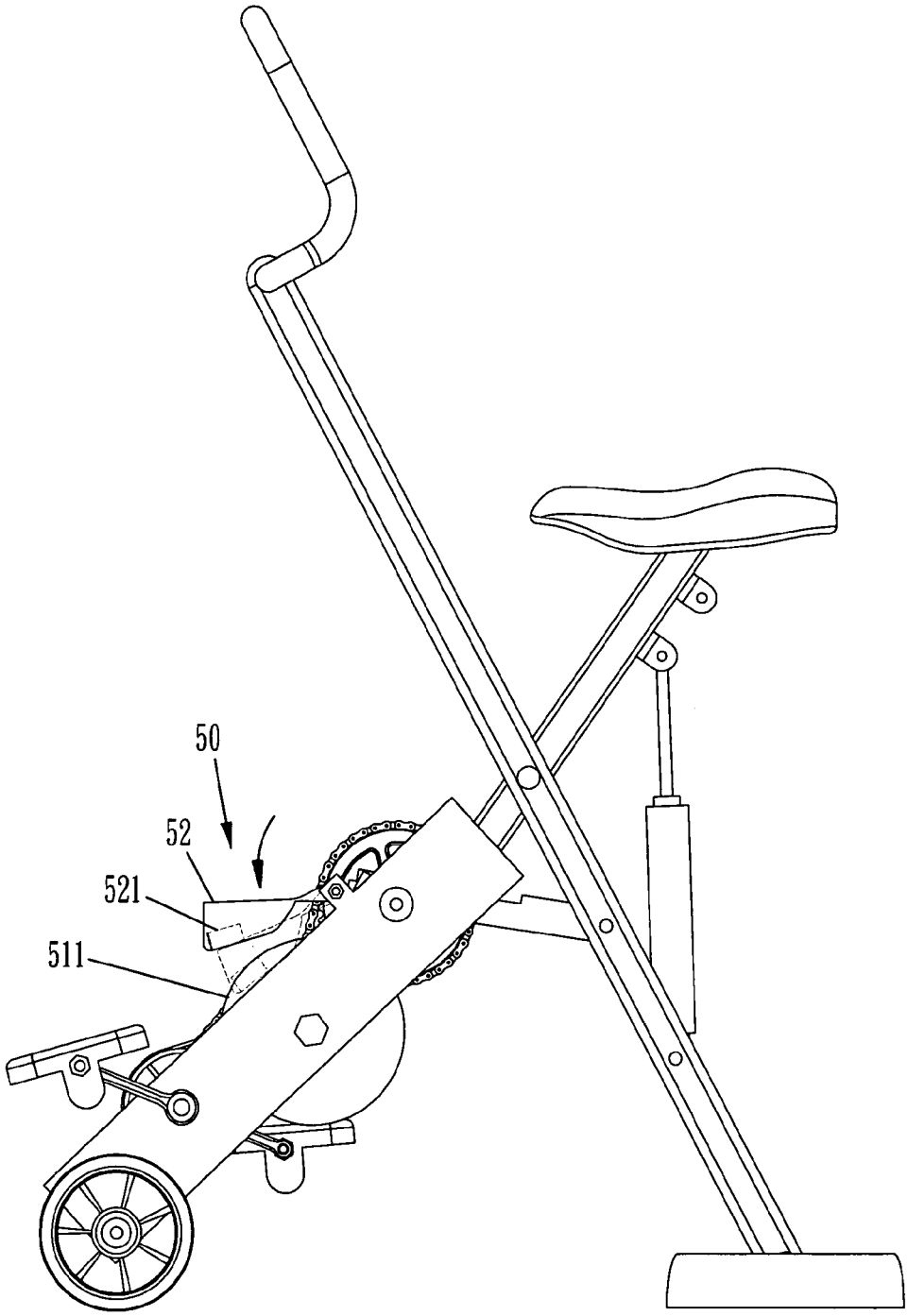
FIG. 5 is a side view of the device of FIG. 2.

As shown in FIG. 5, the damper 50 can be manually regulated the distance between the magnet 521 of the magnetic device 52 and the coil 511 of the resisting wheel 51 to create the varied resistance of tramping exercise.

It will be appreciated by persons skilled in the art that the present invention is not limited to what has been particularly shown and described herein, and that the drawings are not necessarily to scale. A variety of modifications and variations are possible in light of the above teachings without departing from the scope and spirit of the invention, which is limited only by the following claims.

What is claimed is:

1. An exercise device comprising:

a seat stand and a handle stand crisscrossing on a pivotally axis;

a seat set on top of the seat stand;

a set of gears pivotally engaged on the seat stand for regulating the speed of scissoring movement of the seat stand and the handle stand;

a pair of pedals with a pair of cranks joined on the gears;

a damper to create the adjustable resistance of the pedal;

a pulley to drive the damper;

a shock absorber to smooth the resistance of the pedals;

a shaft pivotally connected between the gears and the handle stand to move the seat stand and the handle stand in a kind of scissoring movement;

a base pivotally engaged with lower end of the handle stand; and a slide device connecting on the lower end of the seat stand for allowing it to shift on the ground.

2. The exercise device of claim 1, wherein the damper includes a resisting wheel with a coil and a magnetic device with at least a magnet to regulate the distance between the magnet and the coil for creating a desired resistance.

3. The exercise device of claim 1, wherein the handle stand is set a shaft pivot to linkage the handle stand and the gears.

4. The exercise device of claim 1, wherein the shock absorber is set the top end on a joint of the seat stand and the lower end on a bumper pivot of the handle stand.

* * * * *